US008223299B2

(12) United States Patent
Araki et al.

(10) Patent No.: US 8,223,299 B2
(45) Date of Patent: Jul. 17, 2012

(54) LIQUID CRYSTAL DISPLAY DEVICE

(75) Inventors: Shigesumi Araki, Ishikawa (JP); Kazuhiro Nishiyama, Ishikawa (JP); Mitsutaka Okita, Ishikawa (JP); Daiichi Suzuki, Miyagi (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 1145 days.

(21) Appl. No.: 11/669,405

(22) Filed: Jan. 31, 2007

(65) Prior Publication Data

US 2007/0176882 A1 Aug. 2, 2007

(30) Foreign Application Priority Data

| | | |
|---|---|---|
| Jan. 31, 2006 | (JP) | 2006-22613 |
| Feb. 23, 2006 | (JP) | 2006-47570 |
| Mar. 1, 2006 | (JP) | 2006-55011 |
| Mar. 1, 2006 | (JP) | 2006-55012 |
| Jan. 30, 2007 | (JP) | 2007-18797 |

(51) Int. Cl.
*G09G 3/36* (2006.01)

(52) U.S. Cl. ..... 349/101; 345/100; 345/690; 315/169.3

(58) Field of Classification Search ..... 345/87–102
See application file for complete search history.

(56) References Cited

U.S. PATENT DOCUMENTS

| | | | | |
|---|---|---|---|---|
| 7,230,596 | B2 * | 6/2007 | Guo et al. | 345/82 |
| 7,602,367 | B2 * | 10/2009 | Kawaguchi | 345/100 |
| 2005/0023986 | A1 * | 2/2005 | Mizukoshi et al. | 315/169.3 |
| 2006/0017682 | A1 * | 1/2006 | Kawaguchi | 345/98 |

FOREIGN PATENT DOCUMENTS

| | | |
|---|---|---|
| JP | 2002-202491 | 7/2002 |
| JP | 2003-15161 | 1/2003 |
| JP | 2004-185027 | 7/2004 |

OTHER PUBLICATIONS

U.S. Appl. No. 12/147,977, filed Jun. 27, 2008, Araki, et al.

* cited by examiner

*Primary Examiner* — Kevin M Nguyen
*Assistant Examiner* — Kenneth B Lee, Jr.
(74) *Attorney, Agent, or Firm* — Oblon, Spivak, McClelland, Maier & Neustadt, L.L.P.

(57) ABSTRACT

The OCB mode liquid crystal display device applies a black display voltage V(Tr) with temperature characteristic requirements expressed by:

$$V(T)=<Vs(T), \text{ and } V(Tr-\Delta T)=V(T)=<Vs(Tr),$$

where T represents a panel temperature of the liquid crystal panel, Tr represents a sensed temperature, ΔT represents a temperature difference between the panel temperature and the sensed temperature, and Vs(T) represents an optimal black display voltage.

17 Claims, 15 Drawing Sheets

FIG.16

| PANEL TEMPERATURE | SENSED TEMPERATURE | SET VALUE OF BLACK DISPLAY VOLTAGE | OPTIMAL BLACK DISPLAY VOLTAGE | DIFFERENCE FROM OPTIMAL VOLTAGE | CHECK OF DISPLAY QUALITY |
|---|---|---|---|---|---|
| ℃ | ℃ | ℃ | V | V | JUDGMENT |
| -10 | 1 | 5.3 | 5.4 | -0.1 | OK |
| 0 | 11 | 5 | 5.1 | -0.1 | OK |
| 10 | 21 | 4.8 | 4.7 | 0.1 | OK |
| 20 | 31 | 4.6 | 4.5 | 0.1 | OK |
| 30 | 40 | 4.6 | 4.5 | 0.1 | OK |
| 40 | 50 | 4.5 | 4.4 | 0.1 | OK |
| 50 | 60 | 4.4 | 4.3 | 0.1 | OK |
| 60 | 70 | 4 | 4.1 | -0.1 | OK |
| 70 | 79 | 3.9 | 3.8 | 0.1 | OK |

FIG.17

| PANEL TEMPERATURE | SENSED TEMPERATURE | SET VALUE OF BLACK DISPLAY VOLTAGE | OPTIMAL BLACK DISPLAY VOLTAGE | DIFFERENCE FROM OPTIMAL VOLTAGE | CHECK OF DISPLAY QUALITY |
|---|---|---|---|---|---|
| ℃ | ℃ | ℃ | V | V | JUDGMENT |
| -10 | -10 | 5.7 | 5.4 | 0.3 | REVERSAL OF GRADATION |
| 0 | 0 | 5.4 | 5.1 | 0.3 | REVERSAL OF GRADATION |
| 10 | 10 | 5.1 | 4.7 | 0.4 | REVERSAL OF GRADATION |
| 20 | 20 | 4.7 | 4.5 | 0.2 | REVERSAL OF GRADATION |
| 30 | 30 | 4.5 | 4.5 | 0 | OK |
| 40 | 40 | 4.5 | 4.4 | 0.1 | OK |
| 50 | 50 | 4.5 | 4.3 | 0.2 | REVERSAL OF GRADATION |
| 60 | 60 | 4.4 | 4.1 | 0.3 | REVERSAL OF GRADATION |
| 70 | 70 | 4.1 | 3.8 | 0.3 | REVERSAL OF GRADATION |

FIG.18

| PANEL TEMPERATURE | SENSED TEMPERATURE | SET VALUE OF BLACK DISPLAY VOLTAGE | OPTIMAL BLACK DISPLAY VOLTAGE | DIFFERENCE FROM OPTIMAL VOLTAGE | CHECK OF DISPLAY QUALITY |
|---|---|---|---|---|---|
| ℃ | ℃ | ℃ | V | V | JUDGMENT |
| -10 | -10 | 5.3 | 5.4 | -0.1 | OK |
| 0 | 0 | 5.2 | 5.1 | 0.1 | OK |
| 10 | 10 | 4.7 | 4.7 | 0 | OK |
| 20 | 20 | 4.6 | 4.5 | 0.1 | OK |
| 30 | 30 | 4.5 | 4.5 | 0 | OK |
| 40 | 40 | 4.5 | 4.4 | 0.1 | OK |
| 50 | 50 | 4.4 | 4.3 | 0.1 | OK |
| 60 | 60 | 4.1 | 4.1 | 0 | OK |
| 70 | 70 | 3.7 | 3.8 | -0.1 | OK |

LIQUID CRYSTAL DISPLAY DEVICE

FIELD OF THE INVENTION

The present invention relates to a liquid crystal display device, and more specifically a liquid crystal display device using OCB (Optically compensated Bend) alignment technique which can achieve a wide viewing angle and high-speed response.

BACKGROUND ART

A liquid crystal display device is applied to various fields taking advantage of the features such as a light weight, a low-profile body, and low power consumption. In recent years, an OCB mode liquid crystal display device has been in the limelight as a liquid crystal display device which allows a viewing angle and a response speed to be improved. An OCB mode liquid crystal display device like this has a liquid crystal layer having liquid crystal molecules held between a pair of substrates; the molecules can be aligned in a bend. OCB mode like this is further improved in response speed by one digit in comparison to TN (Twisted Nematic) mode. Further, OCB mode has the advantage that it can offer a wide viewing angle because the influence of birefringence of light traveling through the liquid crystal layer can be optically compensated in accordance with the alignment of liquid crystal molecules (see e.g. Japanese Application Kokai No. 2002-202491).

As for OCB mode liquid crystal display device, it becomes possible to display in black at only a certain voltage because display is performed by means of birefringence of light. As shown in FIG. 5, in a range of Second Voltage above the optimal black display voltage, the transmittance is increased and thus, the reversal of gradation occurs. Therefore, with OCB mode liquid crystal display device, the black display voltage V is set to a value Vs of the optimal black display voltage which is a bottom of brightness; in regard to a display voltage for another color gradation, a voltage lower than the optimal black display voltage Vs (in a range of First Voltage in FIG. 5) is applied for display.

Meanwhile, as shown by a solid line in FIG. 6, the optimal black display voltage Vs(T) has a temperature characteristic that it lowers with a rise in the panel temperature T. On this account, a conventional OCB mode liquid crystal display device is equipped with a temperature sensor, and corrects the black display voltage V(T) according to a temperature Tr sensed by the sensor and therefore performs temperature compensation, as shown by a dotted line in FIG. 6 (see e.g. Japanese Application Kokai No. 2004-185027).

In such OCB mode liquid crystal display device which performs the temperature compensation, a temperature sensor is provided on a printed wiring board mounted with a drive circuit for a liquid crystal display device. Therefore, such OCB mode liquid crystal display device tends to sense a temperature higher than an actual panel temperature T owing to heat from a backlight and heat from an electronic part. On this account, a measure to correct the temperature difference ΔT and then apply a black display voltage V(Tr) has been taken conventionally. The black display voltage V(Tr) indicated by the dotted line in FIG. 6 shows the case where the temperature difference ΔT between the panel temperature T and sensed temperature Tr is 10° C. In this case, as the black display voltage V(T) is to be applied over all temperature zones at and below the optimal black display voltage Vs(T), the reversal of gradation never occurs.

However, as for an OCB mode liquid crystal display device as described above, immediately after its power source is turned on, there is neither heat from a backlight nor heat from an electronic part. Therefore, the temperature difference ΔT between a sensed temperature Tr and panel temperature T does not arise. Thus, the temperature characteristic exhibits a situation as shown by a single dot & dash line in FIG. 6 apparently.

Specifically, as a result of no temperature difference ΔT, the black display voltage is increased by an amount corresponding to an estimated temperature difference, and then it exceeds the optimal black display voltage Vs(T). Consequently, reversal of the gradation is occurred at the starting time when the power source is turned on. This is a problem that an OCB mode liquid crystal display device as described above has. For example, the black display voltage is at or above the optimal black display voltage Vs(T) and the reversal of gradation occurs around a room temperature (20 to 30° C.), as shown in FIG. 6.

Therefore, in consideration of the above-described problem, the invention aims at providing an OCB mode liquid crystal display device in which no reversal of gradation is caused not only when it is in its stable state but also at the time of activation thereof.

SUMMARY

A liquid crystal display device according to the first embodiment of the invention has an OCB mode liquid crystal panel, and includes: a temperature-sensing unit configured to sense a temperature Tr around the liquid crystal panel; a liquid crystal drive voltage-applying unit configured to determine a black display voltage V(Tr) when brightness of the liquid crystal panel is made minimum with respect to the sensed temperature Tr and applying the black display voltage V(Tr). In the liquid crystal display device, the liquid crystal drive voltage-applying unit applies the black display voltage V(Tr) satisfying temperature characteristic requirements expressed by:

$$V(T)=<Vs(T) \text{ and,}$$

$$V(Tr-\Delta T)=V(T)=<Vs(Tr),$$

where T is a panel temperature of the liquid crystal panel, ΔT is a temperature difference between the sensed temperature Tr and panel temperature T, and Vs(T) is an optimal black display voltage which lowers with a rise of the panel temperature T.

A liquid crystal display device according to the second embodiment of the invention includes: an OCB mode liquid crystal panel having a pair of substrates and a liquid crystal layer held between the paired substrates; a temperature-sensing unit configured to sense a temperature of a periphery of the liquid crystal panel when the liquid crystal panel is installed in a housing; and a control unit configured to control a black display voltage to be applied to the liquid crystal layer depending on a panel temperature of the liquid crystal panel in order to display a black image. In the liquid crystal display device, the control unit corrects a sensed temperature sensed by the temperature-sensing unit based on a predetermined correction amount, and sets the black display voltage depending on a correction temperature produced by the correction.

A liquid crystal display device according to the third embodiment of the invention includes: an OCB mode liquid crystal panel having a pair of substrates and a liquid crystal layer held between the paired substrates; a temperature-sensing unit configured to sense a temperature of a periphery of the liquid crystal panel when the liquid crystal panel is installed in a housing; a control unit configured to control a black display voltage to be applied to the liquid crystal layer depending on a panel temperature of the liquid crystal panel in order to display a black image; a first memory which stores a correction amount between a sensed temperature sensed by the temperature-sensing unit and the panel temperature of the liquid crystal panel; and a second memory which stores a correction table of the black display voltage to be applied to the liquid crystal layer with respect to the panel temperature of the liquid crystal panel. In the liquid crystal display device, the control unit corrects the sensed temperature sensed by the temperature-sensing unit based on the correction amount stored in the first memory, and sets the black display voltage depending on a correction temperature produced by the correction based on the correction table stored in the second memory.

A liquid crystal display device according to the fourth embodiment of the invention includes: an OCB mode liquid crystal panel having a pair of substrates and a liquid crystal layer held between the paired substrates; a temperature-sensing unit configured to sense a temperature of a periphery of the liquid crystal panel; and a control unit configured to control a black display voltage to be applied to the liquid crystal layer depending on a panel temperature of the liquid crystal panel in order to display a black image. In the liquid crystal display device, the control unit sets the black display voltage to a predetermined constant voltage based on a sensed temperature sensed by the temperature-sensing unit when having sensed a temperature below a particular temperature, and the control unit sets the black display voltage so that the higher the sensed temperature is, the lower the black display voltage is in comparison to the constant voltage when having sensed a temperature equal to or above the particular temperature.

A liquid crystal display device according to the fifth embodiment of the invention includes: an OCB mode liquid crystal panel having a pair of substrates and a liquid crystal layer held between the paired substrates; a temperature-sensing unit configured to sense a temperature of a periphery of the liquid crystal panel; a control unit configured to control a black display voltage to be applied to the liquid crystal layer depending on a panel temperature of the liquid crystal panel in order to display a black image; a first memory which stores a correction amount between a sensed temperature sensed by the temperature-sensing unit and the panel temperature of the liquid crystal panel; and a second memory which stores a correction table of the black display voltage to be applied to the liquid crystal layer with respect to the panel temperature of the liquid crystal panel. In the liquid crystal display device, the correction table is data covering a voltage distribution taking a predetermined constant voltage with respect to a temperature below a particular temperature, and taking a voltage so that the higher the sensed temperature is, the lower the voltage is in comparison to the constant voltage, with respect to the sensed temperature equal to or above the particular temperature, and the control unit corrects the sensed temperature sensed by the temperature-sensing unit based on the correction amount stored in the first memory, and sets the black display voltage depending on a correction temperature produced by the correction based on the correction table stored in the second memory.

A liquid crystal display device according to the sixth embodiment of the invention includes: an OCB mode liquid crystal panel having a pair of substrates and a liquid crystal layer held between the paired substrates; a temperature-sensing unit configured to sense a temperature of a periphery of the liquid crystal panel; a control unit configured to control a black display voltage to be applied to the liquid crystal layer depending on a temperature of the liquid crystal panel in order to display a black image; and a measurement unit configured to measure an elapsed time. In the liquid crystal display device, the control unit sets the black display voltage depending on the temperature sensed by the temperature-sensing unit from power-on to time when the measurement unit has measured a predetermined length of time, corrects the temperature sensed by the temperature-sensing unit, and sets the black display voltage depending on a temperature produced by the correction from and after the time when the measurement unit has measured the predetermined length of time from the power-on.

A liquid crystal display device according to the seventh embodiment of the invention includes: an OCB mode liquid crystal panel having a pair of substrates and a liquid crystal layer held between the paired substrates; a temperature-sensing unit configured to sense a temperature of a periphery of the liquid crystal panel; a control unit configured to control a black display voltage to be applied to the liquid crystal layer depending on a temperature of the liquid crystal panel in order to display a black image; a measurement unit configured to measure an elapsed time; and a memory which stores first correction data of the black display voltage to be applied to the liquid crystal layer with respect to the temperature of the liquid crystal panel, and second correction data of the black display voltage to be applied to the liquid crystal layer with respect to the temperature sensed by the temperature-sensing unit. In the liquid crystal display device, the control unit sets the black display voltage depending on the temperature sensed by the temperature-sensing unit based on the first correction data from power-on to time when the measurement unit has measured a predetermined length of time, and sets the black display voltage based on the second correction data depending on the temperature sensed by the temperature-sensing unit from and after the time when the measurement unit has measured the predetermined length of time from the power-on.

A liquid crystal display device according to eighth embodiment of the invention includes: an OCB mode liquid crystal panel having a pair of substrates and a liquid crystal layer held between the paired substrates; a temperature-sensing unit configured to sense a temperature of a periphery of the liquid crystal panel; a control unit configured to control a black display voltage to be applied to the liquid crystal layer depending on a temperature of the liquid crystal panel in order to display a black image; a measurement unit configured to measure an elapsed time; and a memory which stores correction data of the black display voltage to be applied to the liquid crystal layer with respect to the temperature of the liquid crystal panel. In the liquid crystal display device, the control unit sets the black display voltage based on the correction data depending on the temperature sensed by the temperature-sensing unit from power-on to time when the measurement unit has measured a predetermined length of time, and sets the black display voltage to a value lower than a value depending on the temperature sensed by the temperature-sensing unit based on the correction data from and after the time when the measurement unit has measured the predetermined length of time from the power-on.

The invention can provide an OCB mode liquid crystal display device having a good display quality regardless of the use environment thereof. According to the invention, the black display voltage never exceeds the optimal black display voltage even at the time of start of the display device, and therefore the reversal of gradation is not caused.

BRIEF DESCRIPTION OF THE DRAWINGS

FIG. 16 is a view showing differences between black display voltages set in a stable condition and optimal black display voltages and results of judgment of resulting display qualities in association with the sixth embodiment;

FIG. 17 is a view showing differences between black display voltages set right after power-on in the same way as in the stable condition and optimal black display voltages, and results of judgment of resulting display qualities in association with the sixth embodiment;

FIG. 18 is a view showing differences between black display voltages set by use of a technique according to the embodiment right after the power-on and optimal black display voltages, and results of judgment of resulting display qualities in association with the sixth embodiment.

DETAILED DESCRIPTION OF THE INVENTION

An OCB mode liquid crystal display device 1 according to an embodiment of the invention will be described below in reference to the drawings. The liquid crystal display device 1 described here is a light-transmission type one. However, it may be the following. The first is a reflection type one which reflects extraneous light selectively thereby to display an image. The second is a transmission type one which allows light from a backlight to go therethrough selectively thereby to display an image. The third is a transreflective type which has a reflection part and a transmission part.

First Embodiment

Figure 1:
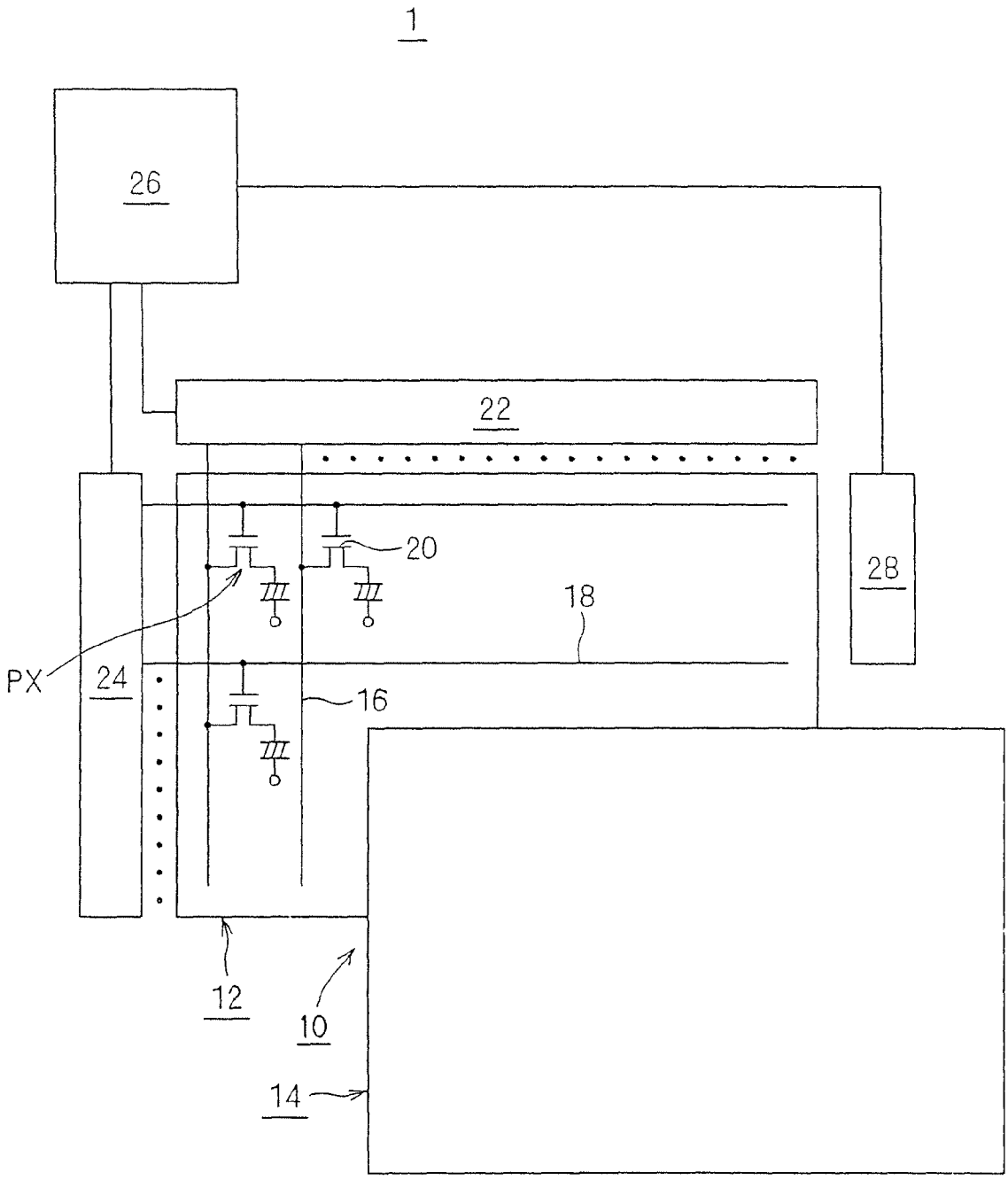
FIG. 1 is a block diagram of a liquid crystal display device according to the first embodiment of the invention.

Now, a liquid crystal display device 1 according to the first embodiment will be described in reference to FIGS. 1 and 2.

1. Configuration of Liquid Crystal Display Device 1

The configuration of the liquid crystal display device 1 will be described here in reference to FIG. 1.

A liquid crystal panel 10 of the liquid crystal display device 1 has an array substrate 12, an opposing substrate 14, and a liquid crystal layer (liquid crystal of OCB mode) 30 held between the substrates 12 and 14.

The array substrate 12 is laid out on a glass substrate so that a plurality of signal lines 16 and a plurality of scan lines 18 intersect each other at a right angle. In a vicinity of each of intersecting points of the signal lines 16 and scan lines 18, a thin film transistor formed of polycrystalline silicon or an MIM (Metal Insulated Metal), which is hereinafter referred to as "TFT" 20, is formed; the TFTs thus formed are arrayed in the form of a matrix.

Figure 7:
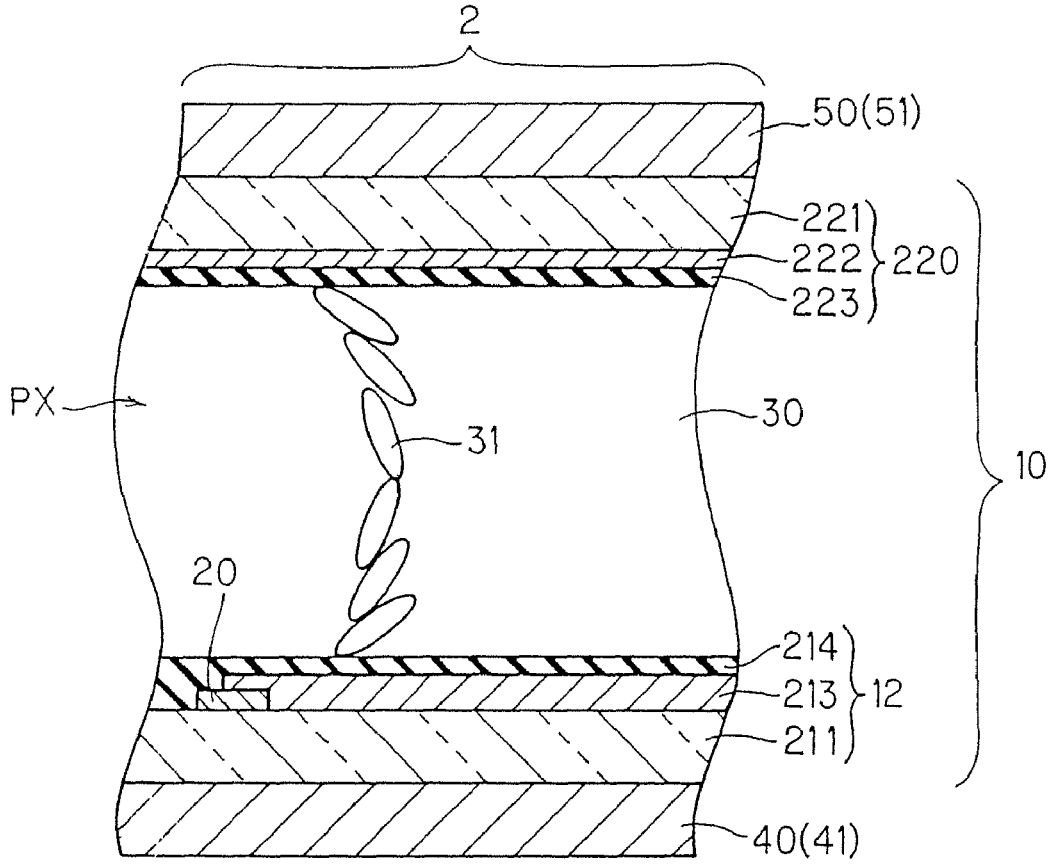
FIG. 7 is a view schematically showing a configuration of an OCB mode liquid crystal display device in association with the fourth to sixth embodiments of the invention.

As shown in FIG. 7, the array substrate 12 is formed with an optically-transparent insulating substrate 211 such as a glass. The array substrate 12 has the following on one primary face of the insulating substrate 211: a plurality of scan lines 18 placed along a direction of the row of display pixels PX; a plurality of signal lines 16 placed along a direction of the column of the display pixels PX; TFTs 20 placed in vicinities of intersecting points of the scan lines 18 and signal lines 16, one of which is arranged for each display pixel PX; pixel electrodes 213, one of which is placed for each display pixel PX and connected to the corresponding TFT 20; and an alignment film 214 placed so as to cover the entire primary face of the insulating substrate 211. As for the transmission type liquid crystal panel 10, the pixel electrodes 213 are formed of e.g. an optically-transparent conducting material, e.g. ITO (Indium Tin Oxide). In the case of the reflection type liquid crystal panel 10, the pixel electrodes 213 can be formed of a reflective material for an electrode, e.g. aluminum.

The opposing substrate 14 is formed with an optically-transparent insulating substrate 221 such as a glass. The opposing substrate 14 has an opposing electrode 222 placed on one primary face of the insulating substrate 221 commonly to all the display pixels, and an alignment film 223 placed so as to cover the entire primary face of the insulating substrate 221. The opposing electrode 222 is formed from an optically-transparent conducting material, e.g. ITO.

The array substrate 12 and opposing substrate 14, which are configured as described above, are arranged with a predetermined gap interposed therebetween and maintained by spacers (not shown), and adhered to each other with a seal material. The liquid crystal layer 30 is sealed in the gap between the array substrate 12 and opposing substrate 14. In this embodiment, the liquid crystal panel 10 has a structure to which OCB (Optically compensated Bend) mode is applied. The liquid crystal layer 30 is formed of a material containing liquid crystal molecules 31 and having a positive dielectric constant anisotropy and an optically positive uniaxial property. In a predetermined display state where a voltage is applied to the liquid crystal layer 30, the liquid crystal molecules 31 are aligned in a bend between the array substrate 12 and opposing substrate 14.

A first optically compensated element 40 placed on an outer face of the array substrate 12 and a second optically compensated element 50 placed on an outer face of the opposing substrate 14 have the function of optically compensating a retardation of the liquid crystal layer 30 in a predetermined display state where a voltage is applied to the liquid crystal layer 30 in the liquid crystal panel 10 as described above.

The TFTs 20 are driven when a signal line driver circuit 22 supplies the TFTs 20 with a liquid crystal driving voltage as a video signal through the plurality of signal lines 16 and a scan line driver circuit 24 inputs a gate signal through the plurality of scan lines 18 to the TFTs 20.

The signal line driver circuit 22 and scan line driver circuit 24 are under control by a controller 26. The controller 26 accepts input of data concerning a sensed temperature Tr from a digital temperature sensor 28. The temperature sensor 28 is mounted on a printed wiring board on which the controller 26 is mounted.

2. Manner of Operation

Now, a manner of the operation of applying a black display voltage V(Tr) will be described which is based on a sensed temperature Tr detected by the temperature sensor 28.

As described above, a temperature difference ΔT arises between a sensed temperature Tr and a panel temperature T. For instance, in the case where the liquid crystal display device 1 has been used for an hour or longer, the sensed temperature Tr is higher than the panel temperature T by 10° C. approximately. This is because the sensed temperature is affected by heat from a backlight and heat from the electronic parts. It is noted here that the panel temperature T refers to a temperature of liquid crystal of the liquid crystal layer. At the time of start when the power of the liquid crystal display device 1 is turned on, the temperature difference ΔT does not arise between the sensed temperature Tr and panel temperature T.

Figure 2:
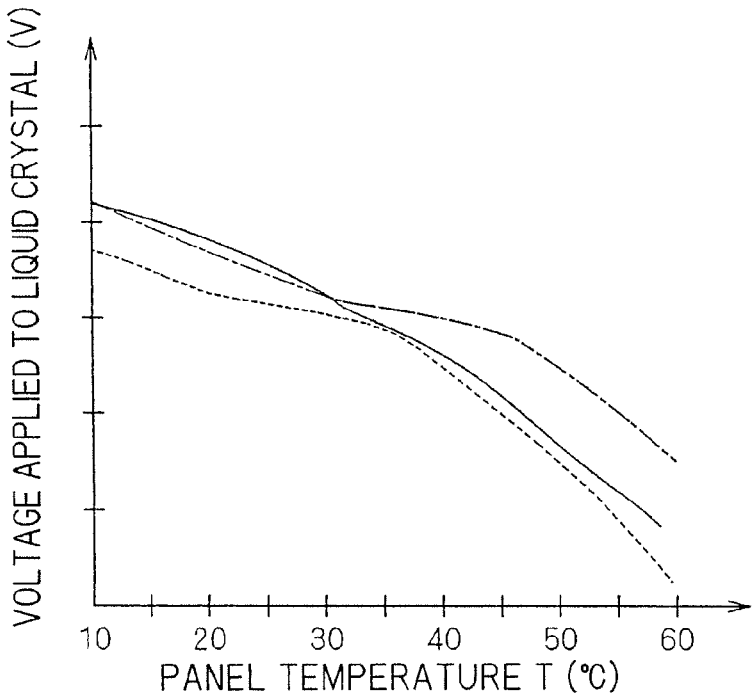
FIG. 2 is a graph showing the relation between a voltage applied to liquid crystal and a panel temperature in regard to the liquid crystal display device of FIG. 1.

In this embodiment, in order to prevent the reversal of gradation from being caused at the time of start, the signal line driver circuit 22 is made to apply a black display voltage V(Tr) as shown by the dotted line in FIG. 2 so that the black display voltage V(Tr) is equal to or lower than the optimal black display voltage Vs(Tr).

As for the black display voltage V(Tr), the controller 26 has been made to store a temperature compensation function which includes temperature conditions or requirements as described below. And, the black display voltage V(Tr) output from the signal line driver circuit 22 depending on a sensed temperature Tr is compensated for temperature. Here, the temperature compensation function is stored so that the following two requirements are satisfied.

The first requirement is given by:

$$V(T)=<Vs(T) \quad (1).$$

This is because the reversal of gradation occurs when the black display voltage V(T) exceeds the optimal black display voltage Vs(T) even a little.

The second requirement is given by:

$$V(Tr-\Delta T)=V(T)=<Vs(Tr) \quad (2).$$

This is because, for the purpose of avoiding the reversal of gradation at the time of the start at a sensed temperature Tr of 25° C. when the temperature difference ΔT between the panel temperature T and sensed temperature Tr is 10° C. as described above, it is necessary to make the black display voltage at a panel temperature T of 15° C. equal to or lower than the optimal black display voltage Vs(T) at a sensed temperature Tr of 25° C.

The single dot & dash line in FIG. 2 expresses an apparent black display voltage at the time of the start. The liquid crystal display device 1 is arranged so that the black display voltage is substantially equal to the optimal black display voltage Vs(T) when the panel temperature T is in a stable state while the display device is in use, specifically when the panel temperature is 35° C. here. Therefore, the contrast is not degraded.

As for a display voltage for other color gradation, i.e. a display voltage for a color higher in transmittance than black, the controller 26 changes up and down the voltage in sync with the fluctuation in the black display voltage V(T). Thus, display corresponding to a panel temperature T can be performed with a display voltage for other color gradation.

Second Embodiment

Next, a liquid crystal display device according to the second embodiment of the invention will be described in reference to FIG. 3.

The second embodiment differs from the first one in the temperature compensation function. The first embodiment complicates the temperature compensation function remarkably, and the configuration of the controller 26. Therefore, the second embodiment achieves what the first embodiment achieved more easily.

Figure 3:
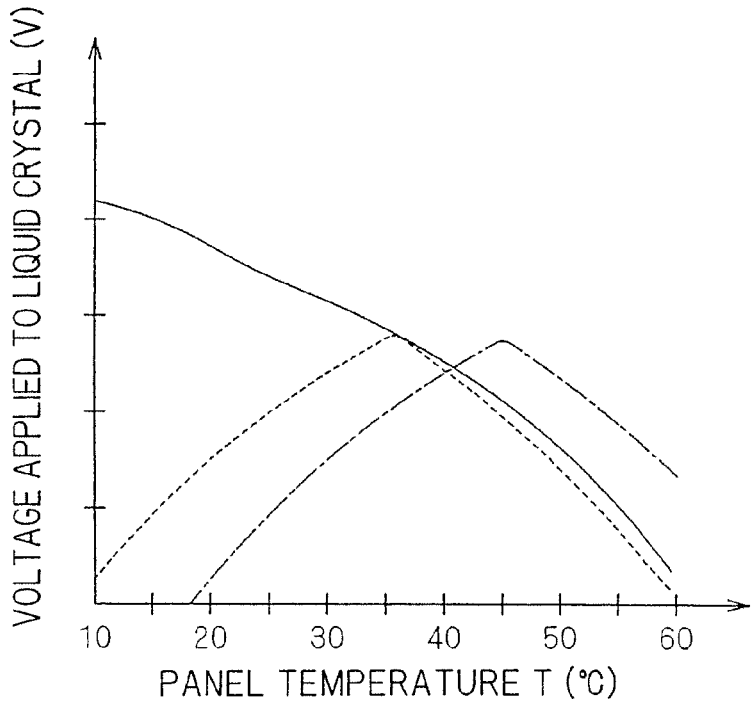
FIG. 3 is a graph showing the relation between a voltage applied to liquid crystal and a panel temperature in regard to a liquid crystal display device according to the second embodiment.

According to the second embodiment, a black display voltage V(T) having a peak temperature Ts as shown by a dotted line in FIG. 3 is applied. Specifically, the temperature compensation is performed so that the black display voltage V(T) has a peak temperature Ts near the panel temperature T in the stable state while the liquid crystal display device 1 is in use, e.g. 35° C. At a temperature T above the peak temperature Ts, the black display voltage V(T) is substantially equal to the optimal black display voltage Vs(T); at a temperature T below the peak temperature Ts the black display voltage V(T) lowers with the panel temperature T.

Also, with this embodiment, the reversal of gradation can be avoided at the time of the start without deteriorating characteristics of the contrast when the panel temperature T is stable.

Third Embodiment

Figure 4:
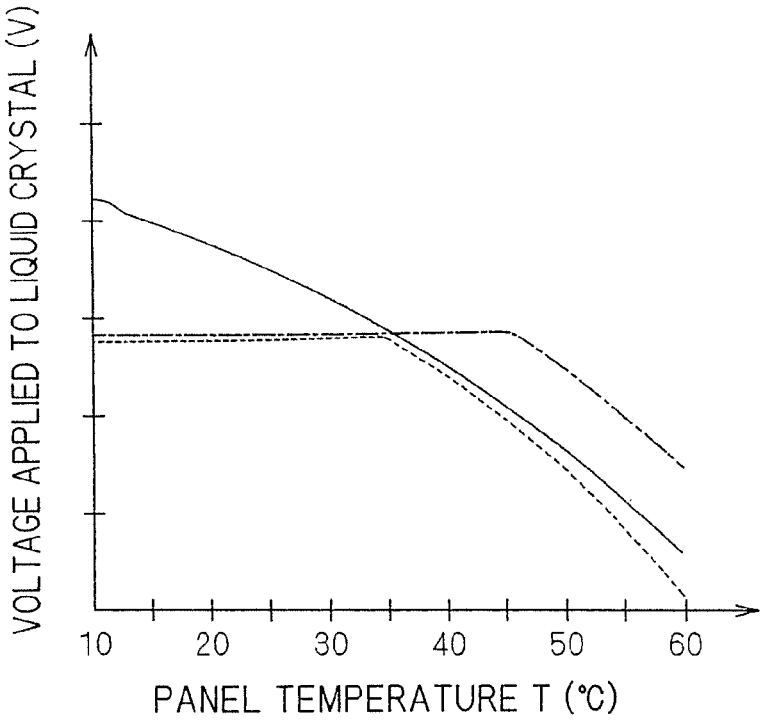
FIG. 4 is a graph showing the relation between a voltage applied to liquid crystal and a panel temperature in regard to a liquid crystal display device according to the third embodiment.
Figure 5:
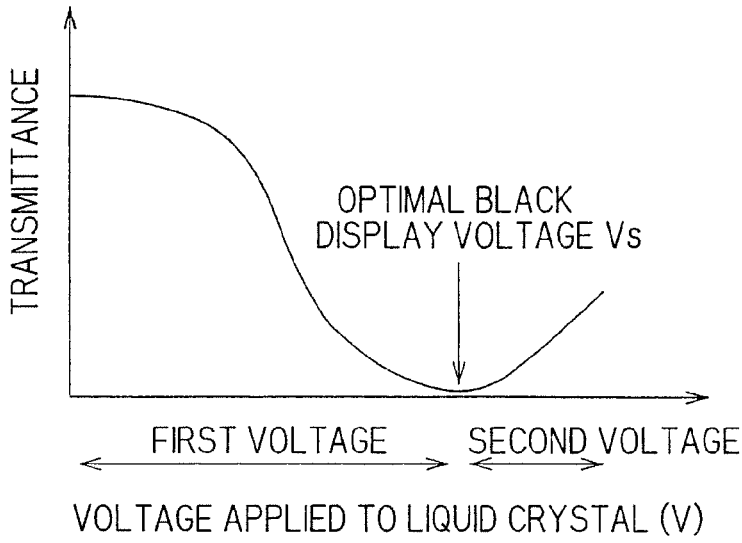
FIG. 5 is a graph showing the relation between a transmittance and a voltage applied to liquid crystal in regard to an OCB mode liquid crystal display device.
Figure 6:
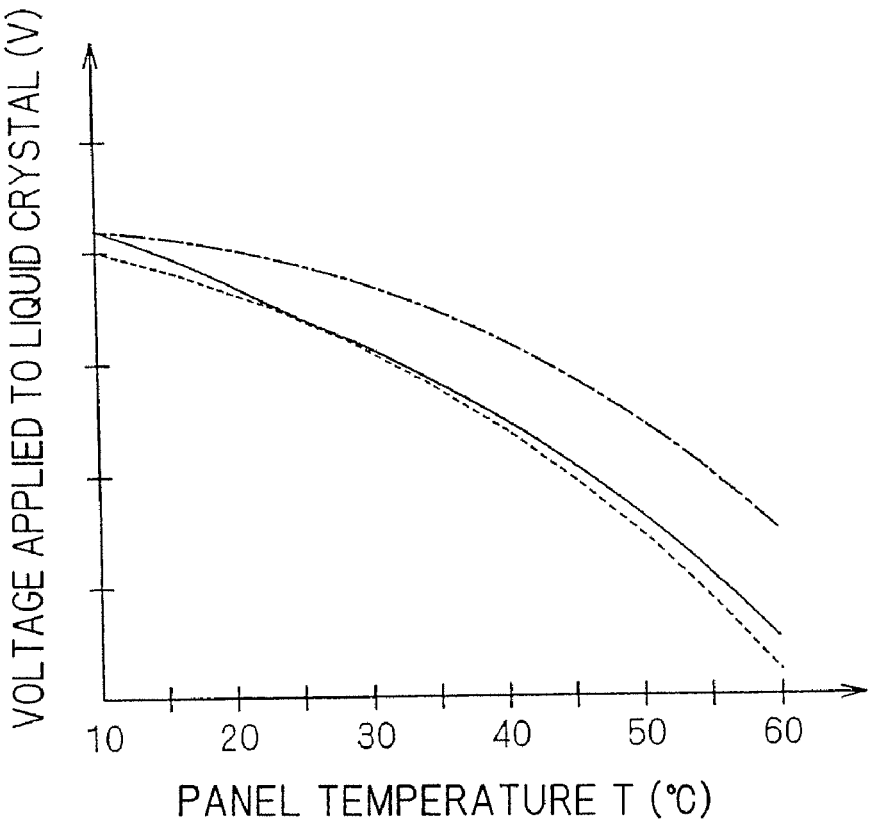
FIG. 6 is a graph showing the relation between a voltage applied to liquid crystal and a panel temperature in regard to a conventional liquid crystal display device.

Now, a liquid crystal display device according to the third embodiment of the invention will be described in reference to FIG. 4.

The third embodiment differs from the second one in the temperature compensation function. In the liquid crystal display device 1 according to the second embodiment, deterioration of the contrast is caused when the panel temperature T is low. This is because the black display voltage V(T) lowers with the panel temperature T when the panel temperature T is below the peak temperature Ts.

Hence, in the third embodiment, the black display voltage V(T) is applied so as to be constant when the panel temperature T is equal to or below a stable panel temperature, e.g. 35° C.

When the black display voltage V(T) is made constant at or below a predetermined temperature as described above, the reversal of gradation at the time of the start can be avoided without deteriorating characteristics of the contrast when the panel temperature T is stable, and deterioration of the contrast at a low temperature can be reduced.

This technique is remarkably useful for an OCB mode liquid crystal display device. However, it is also applicable to a liquid crystal display device which utilizes birefringence as a homogeneous cell does and which has the characteristic of reversal of gradation depending on a setting voltage.

When the panel temperature T is 35° C. or lower, the black display voltage V(T) may be raised so as not to exceed the optimal black display voltage Vs(T) instead of making the black display voltage constant.

Fourth Embodiment

A liquid crystal display device 1 according to the fourth embodiment of the invention will be described below in reference to the drawings.

1. Configuration of the Liquid Crystal Panel

Figure 8:
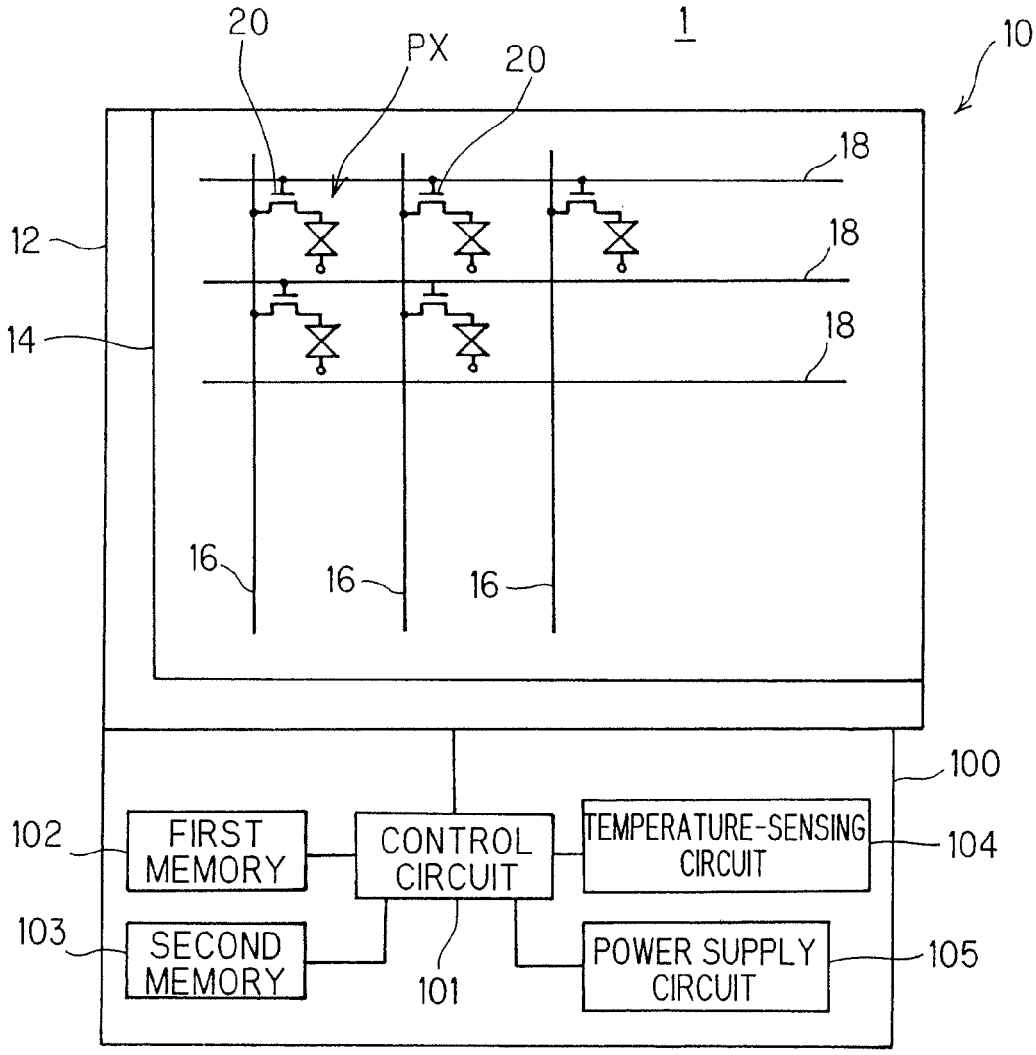
FIG. 8 is a view schematically showing a configuration of a liquid crystal panel according to the fourth and fifth embodiments.

As shown FIGS. 7 and 8, the liquid crystal display device 1 includes an OCB mode liquid crystal panel 10. According to this embodiment, the liquid crystal panel 10 is of a transmission type, and is placed between a first optically compensated element 40 including a polarizer 41 and a second optically compensated element 50 including an analyser 51. The liquid crystal panel 10 is configured so as to hold an OCB mode liquid crystal layer 30 between a pair of substrates, i.e. an array substrate 12 and an opposing substrate 14, provided that the liquid crystal layer 30 is identical with the one which has been described above. The liquid crystal panel 10 includes a plurality of display pixels PX arrayed in a matrix.

The array substrate 12 is formed with an optically-transparent insulating substrate 11 such as a glass. The array substrate 12 has the following on one primary face of the insulating substrate 211: a plurality of scan lines 18 placed along a direction of the row of display pixels PX; a plurality of signal lines 16 placed along a direction of the column of the display pixels PX; TFTs 20 placed in vicinities of intersecting points of the scan lines 18 and signal lines 16, one of which is arranged for each display pixel PX; and pixel electrodes 213, one of which is placed for each display pixel PX and connected to the corresponding TFT 20; and an alignment film 214 placed so as to cover the entire primary face of the insulating substrate 211.

2. Configuration of the Drive Circuit

The liquid crystal panel 10 having a configuration like this is connected to a drive circuit board 100. For example, the drive circuit board 100 is bent and placed on a side of the rear face of the liquid crystal panel 10, i.e. on the side opposite to the display side on which an image is displayed. Otherwise, the drive circuit board 100 is placed along the periphery of the liquid crystal panel 10, for instance. The drive circuit board 100 includes a control circuit 101 for controlling the driving of the liquid crystal panel 10. The control circuit 101 is connected with a first memory 102, a second memory 103, a temperature-sensing circuit 104, a power supply circuit 105, etc.

The first memory 102 and second memory 103 include a storage medium such as a read-only ROM or another type of storage medium such as a rewritable RAM. In the first memory 102 and second memory 103, various kinds of data required for control by the control circuit 101 are stored. The temperature-sensing circuit 104 includes a digital temperature sensor, etc., and outputs a signal corresponding to a temperature Tr sensed by the sensor to the control circuit 101. Here, as the temperature-sensing circuit 104 is mounted on the drive circuit board 100 placed around the liquid crystal panel 10 particularly, it is possible to sense a temperature of the periphery of the liquid crystal panel 10. In addition, when the liquid crystal panel 10 is installed in a housing, a temperature of the periphery of the liquid crystal panel 10 can be sensed with the temperature-sensing circuit 104 inside the housing. The power supply circuit 105 supplies an electric power source for driving the liquid crystal panel 10.

3. Display State in OCB Mode

Figure 9:
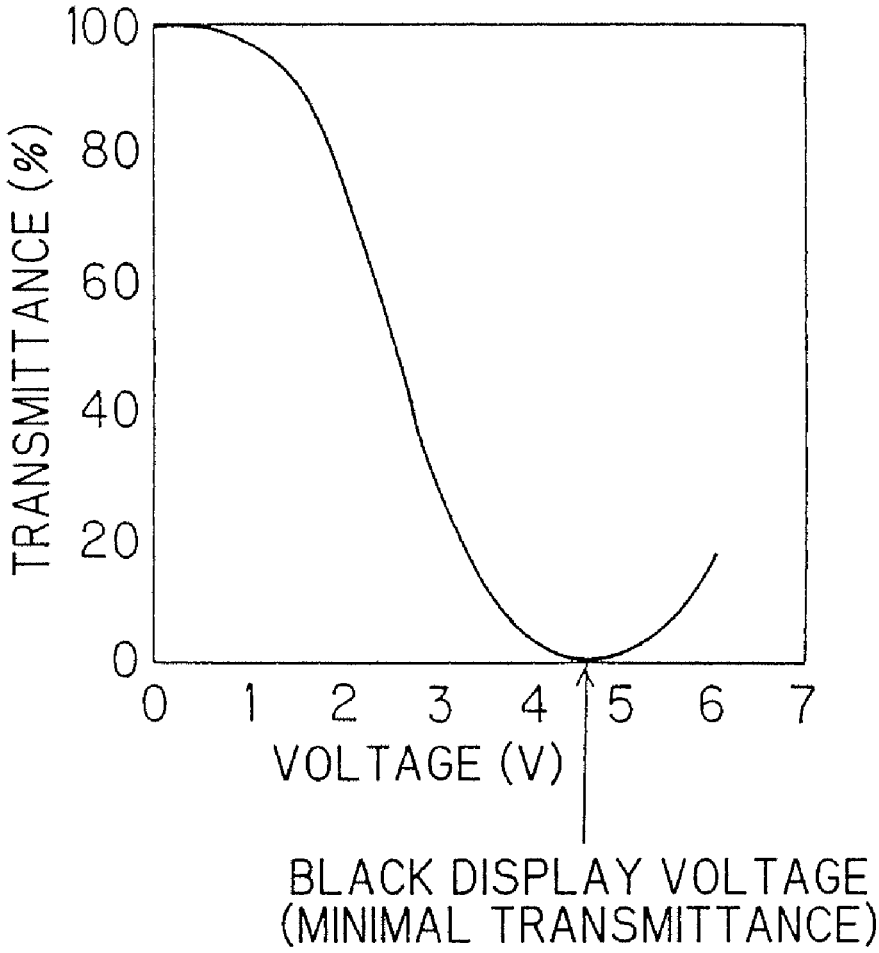
FIG. 9 is a view showing an example of the relation of the transmittance of the liquid crystal panel shown in FIG. 8 with respect to a voltage applied to the liquid crystal layer of the liquid crystal panel.

An OCB mode liquid crystal panel 10 as described above has a disposition to pose a disadvantage, i.e. reversal of gradation, when a voltage equal to or above a constant voltage is applied because it is a display mode using birefringence. With the normally-white mode transmission type liquid crystal display device 1, there is a relation as shown in FIG. 9 between a voltage (V) applied to the liquid crystal layer 30 and a transmittance (%) of the liquid crystal panel 10 when the panel temperature T is 25° C., for example.

Specifically, under the condition where liquid crystal molecules 31 are aligned in a bend between the array substrate 12 and opposing substrate 14, a state in which the transmittance of the liquid crystal panel 10 is maximized represents a state for display of a white image. As the voltage applied to the liquid crystal layer 30 is raised starting with such state, the compensation effects by the first optically compensated element 40 and the second optically compensated element 50 lower the transmittance of the liquid crystal panel 10 gradually. A state in which the transmittance is minimized represents a state for display of a black image. The voltage applied to the liquid crystal layer 30 for the purpose of displaying a black image in this way is referred to as an optimal black display voltage Vs(T), which is 4.5 volts in the example shown in FIG. 9.

When the voltage applied to the liquid crystal layer 30 is further raised starting with such state for display of a black image, the excessive compensation effects by the first optically compensated element 40 and second optically compensated element 50 raise the transmittance of the liquid crystal panel 10 gradually. On this account, when the black display voltage is set to a voltage larger than the optimal black display voltage Vs(T), 4.5 volts, so-called reversal of gradation in which the transmittance of a lower tone exceeds the transmittance of a higher tone is caused. Therefore, the black display voltages have to be designed appropriately or adjusted at every step of the way.

Figure 10:
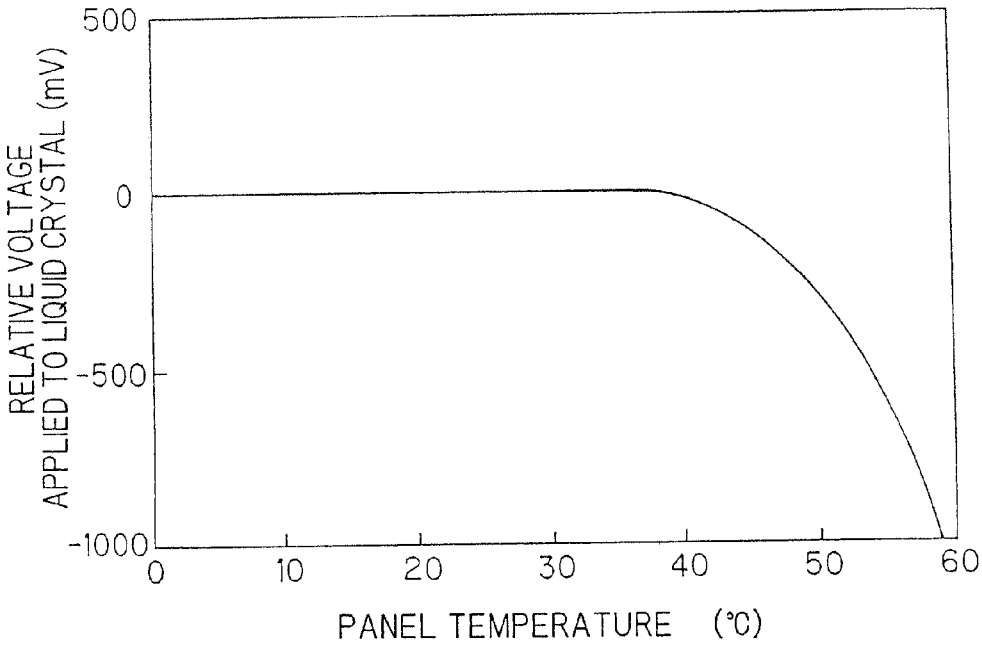
FIG. 10 is a view of assistance in explaining the temperature dependence of a black display voltage in association with the fourth embodiment.

However, an OCB mode liquid crystal panel 10 like this has a temperature dependency in the relation (V-T curve) between a voltage (V) applied to the liquid crystal layer 30 and the transmittance (%) of the liquid crystal panel 10. On this account, the optimal black display voltage Vs(T) also fluctuates according to a temperature as shown FIG. 10, for example. In FIG. 10, the optimal black display voltage to be applied to the liquid crystal layer 30 when the panel temperature T of the liquid crystal panel 10 is 0° C. is used as a reference voltage Vs(T), which is zero volt here, and the optimal black display voltage Vs(T) for another panel temperature T is shown as a relative value. For example, the optimal black display voltage Vs(T) is equal to the reference voltage when the panel temperature T of the liquid crystal panel 10 is 30° C., whereas the optimal black display voltage Vs(T) is −250 millivolts with respect to the reference voltage when the panel temperature of the liquid crystal panel 10 is 50° C.

4. Temperature Compensation

As described above, the reversal of gradation is caused when a voltage higher than the optimal black display voltage Vs(T) is applied to the liquid crystal layer 30 as a black display voltage. Further, when a voltage lower than the optimal black display voltage is applied to the liquid crystal layer 30 as a black display voltage, deterioration of contrast is caused.

On this account, it is required to take a measure including: using a temperature-sensing circuit to sense the panel temperature T of the liquid crystal panel 10; and controlling a voltage to be applied to the liquid crystal layer 30, particularly a black display voltage depending on the panel temperature T of the liquid crystal panel 10. For taking the measure, it is necessary to sense the panel temperature T of the liquid crystal panel 10 per se.

However, it is very difficult to attach a sensor or the like on the insulating substrate that the liquid crystal panel 10 includes. On this account, as described above, the temperature-sensing circuit 104 is provided on a part of a circuit board placed around the liquid crystal panel 10, e.g. the drive circuit board 100. Since it is difficult to directly sense the panel temperature of the liquid crystal panel 10, a temperature difference (ΔT) would be produced between the temperature of the periphery of the liquid crystal panel 10 sensed by the temperature-sensing circuit 104 (sensed temperature Tr) and an actual panel temperature T of the liquid crystal panel 10 as described above.

As the temperature difference ΔT between the sensed temperature Tr and the panel temperature T is substantially constant (e.g. 10° C.) in a main use environment of the liquid crystal display device 1, a correction temperature obtained by performing offset of a certain amount (e.g. subtracting 10° C.) with respect to the sensed temperature Tr becomes substantially equal to the panel temperature of the liquid crystal panel 10.

Hence, in this embodiment, the control circuit 101 performs correction so that a sensed temperature Tr sensed by the temperature-sensing circuit 104 is offset based on a predetermined correction amount, and sets the black display voltage according to the correction temperature produced by the correction. Thus, it becomes possible to perform adequate voltage control.

5. Correction Amount

In regard to the correction amount, a value set when the liquid crystal panel 10 takes a module form before being installed in the housing does not necessarily coincide with a value set when the liquid crystal panel 10 takes an "after-installation form", or a form after being installed in the housing. Specifically, even if the correction amount is set to a predetermined value, e.g. 10° C., based on the difference between the sensed temperature Tr and the panel temperature T in the stage where the module form has been manufactured, the temperature difference ΔT between the sensed temperature Tr and panel temperature T is enlarged or contracted further in comparison to the case where the liquid crystal panel takes the module form when the temperature-sensing circuit 104 is placed in a vicinity of a heat source or a cooling mechanism in the stage where the liquid crystal panel has been brought to the after-installation form. On this account, an optimal correction amount when the liquid crystal panel takes the after-installation form can differ from a predetermined value which has been set when the panel takes the module form.

Figure 11:
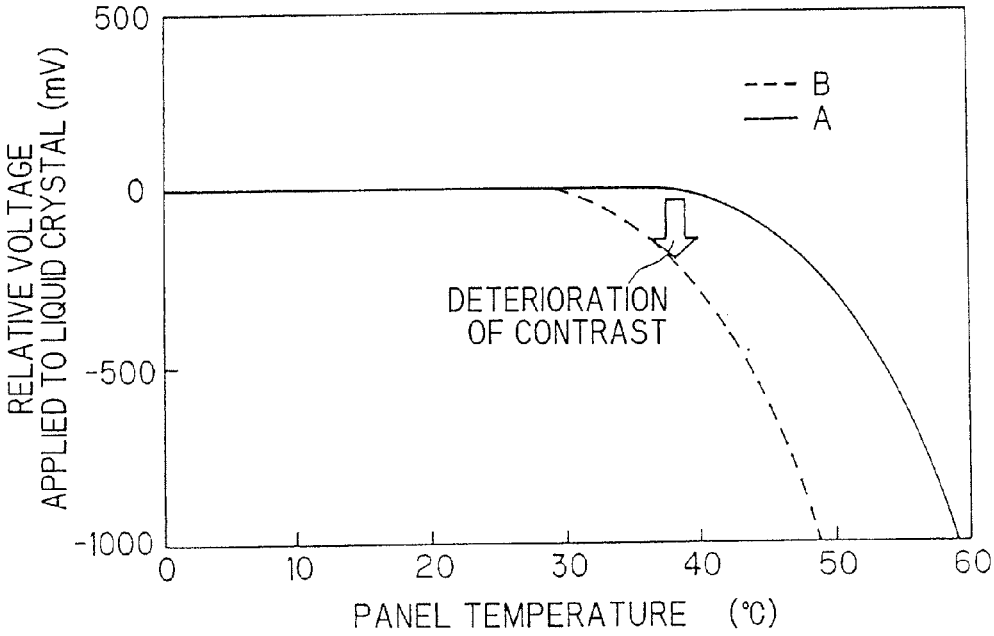
FIG. 11 is a view showing an example of a distribution of an optimal black display voltage with respect to a panel temperature and an example of a distribution obtained by shifting the optimal black display voltage distribution by 10° C. in association with the fourth embodiment.

More specifically, here is considered the case where the optimal black display voltage for the panel temperature of the liquid crystal panel 10 exhibits a distribution as shown by the curve A in FIG. 11. In regard to the module form, on the assumption that there is a temperature difference ΔT of e.g. 10° C. between the sensed temperature Tr and the panel temperature T, the correction amount is set to 10° C. Thus, when the temperature-sensing circuit 104 senses a temperature of 60° C. as the peripheral temperature, for example, the correction by which a correction amount of 10° C. is subtracted from the sensed temperature Tr, 60° C., is performed. Then, the correction temperature of 50° C. is estimated to be the panel temperature T, and reference is made to the distribution A. Thus, a voltage of −250 millivolts with respect to the reference voltage is set as a black display voltage.

On the other hand, with the after-installation form, considered is the case where the temperature difference ΔT between the sensed temperature Tr and the panel temperature T is further enlarged in comparison to the case of the value (10° C.) in the module form. It is assumed here that there is a temperature difference ΔT of e.g. 20° C. between the sensed temperature Tr and the panel temperature T. In this case, when the temperature-sensing circuit 104 senses e.g. 60° C. as a peripheral temperature (sensed temperature Tr), the correction by which a correction amount of 10° C. is subtracted from the sensed temperature Tr, 60° C., is performed as in the case of the module form. Then, the correction temperature of 50° C. is estimated to be the panel temperature T, and reference is made to the distribution A. Thus, a voltage of −250 millivolts with respect to the reference voltage is set as a black display voltage. However, as there is a temperature difference of 20° C. between the sensed temperature and the panel temperature, the panel temperature is 40° C. actually. Therefore, based on such actual temperature and on the distribution A, a proper voltage with respect to the reference voltage should be set as a black display voltage.

More specifically, when the temperature difference ΔT between the sensed temperature Tr and the panel temperature T in the after-installation form is larger than that in the module form, a voltage lower than a value that should be applied as the optimal black display voltage ends up being set as a black display voltage. The voltage on a curve shown in FIG. 11 will be set as the black display voltage. This leads to deterioration of contrast. On contrary, when the temperature difference ΔT between the sensed temperature Tr and the panel temperature T in the after-installation form is contracted in comparison to that in the module form, a voltage higher than a value that should be applied as the optimal black display ends up being set as a black display voltage, which causes the reversal of gradation.

Therefore, in this embodiment, the correction amount of the sensed temperature is set based on the difference between the sensed temperature Tr and the panel temperature T in the after-installation form. Specifically, in the case where the temperature difference between the sensed temperature Tr and the panel temperature T in the after-installation form exceeds a design value for the module form, a value resulting from the addition of the excess amount is set as a correction amount. Further, in the case where the temperature difference in the after-installation form is below the design value for the module form, a value resulting from the subtraction of the shortfall is set as a correction amount. Thus, in addition to the difference between the sensed temperature Tr and the panel temperature T in the module form, the influence of the environment where the temperature-sensing circuit is placed in the after-installation form is taken into account, which enables practice of more adequate voltage control depending on its use environment. This allows good display quality to be achieved regardless of the use environment.

6. Method of Voltage Control

Now, more detailed description on a method of voltage control will be presented.

In the above-described embodiment, the first memory 102 suffices as long as it stores at least a correction amount corresponding to the temperature difference ΔT between the sensed temperature Tr and the panel temperature T, e.g. data corresponding to "20," in the after-installation form as data required for control of the black display voltage by the control circuit 101. The second memory 103 suffices as long as it stores at least a correction table covering the distribution of the black display voltage to be applied to the liquid crystal layer with respect to a panel temperature T, e.g. data covering the distribution A in FIG. 11, as data required for control of the black display voltage by the control circuit 101.

It is desirable that the first memory 102 include a rewritable storage medium. The correction amount to be stored in the first memory 102 will probably differ depending on the specifications of the housing in which the liquid crystal panel is installed. Also, there is a high probability that the liquid crystal panel will require finely adjustment after being installed in the housing. On this account, are writable storage medium is used in order to store a correction amount, thereby making it possible to change the correction amount depending on the use environment appropriately.

Such storing of a correction amount into the first memory 102 and the change of a correction amount in the first memory are performed as follows, for example. That is, on acceptance of input of data corresponding to the correction amount from the outside, the control circuit 101 writes data corresponding to the input correction amount into the first memory 102.

The correction table to be stored in the second memory 103 is prepared based on the characteristics inherent in the liquid crystal panel 10, and therefore it does not require rewrite generally. Therefore, the second memory 103 may be a read-only storage medium.

Figure 12:
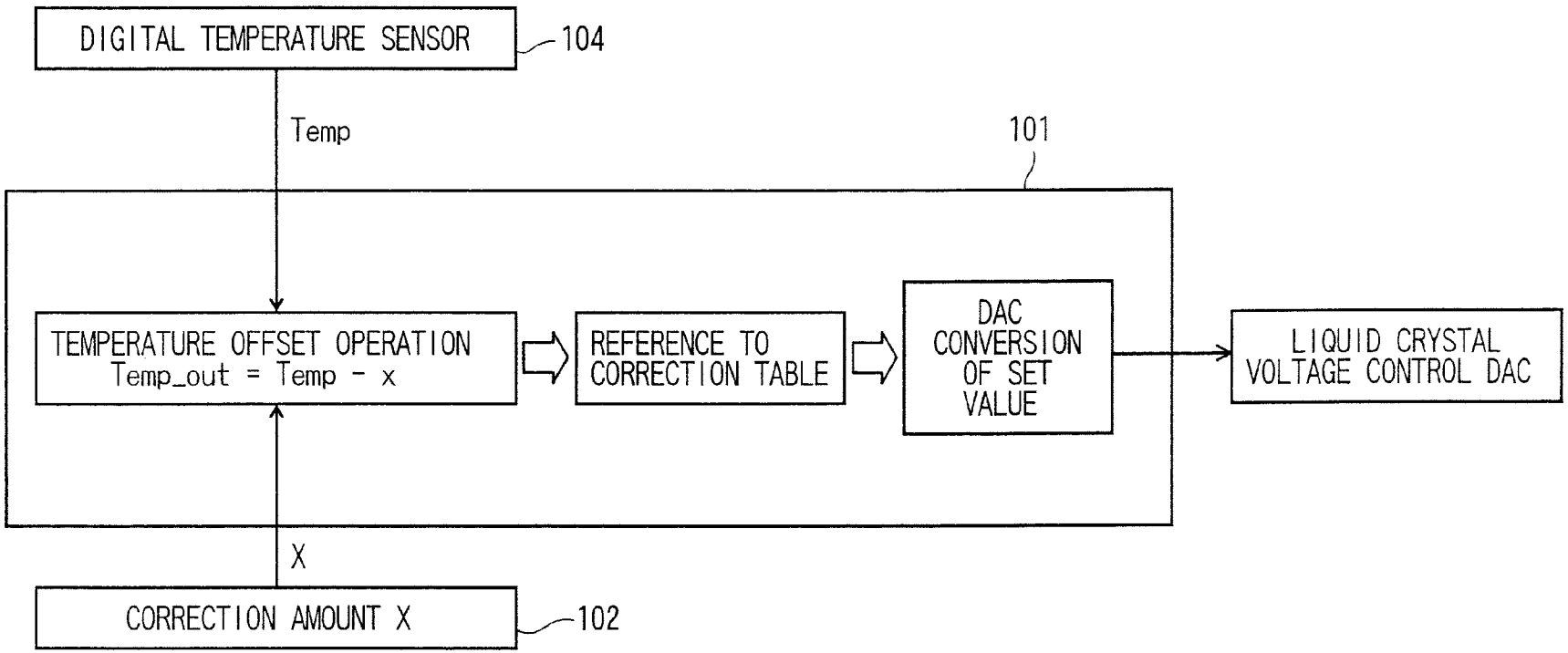
FIG. 12 is a view of assistance in explaining a voltage control method for an after-installation form.
Figure 13:
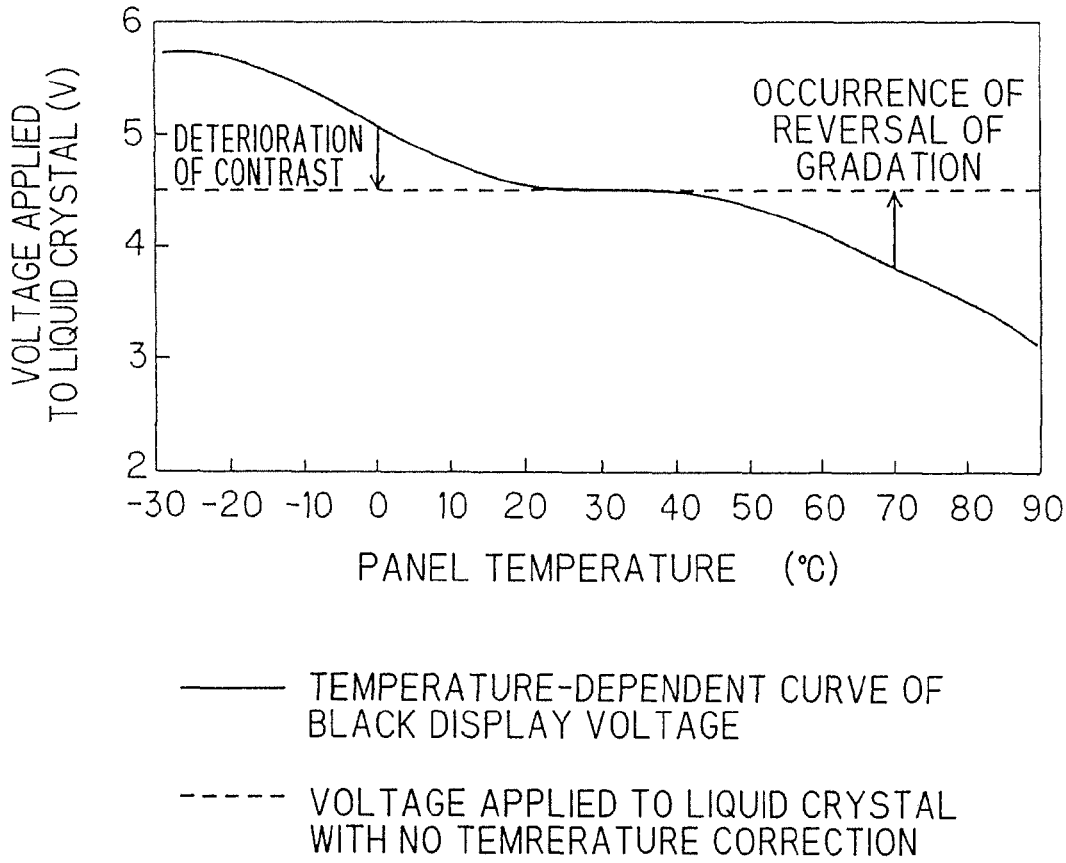
FIG. 13 is a view of assistance in explaining the temperature dependence of a black display voltage in association with the fifth and sixth embodiments.

In such configuration, as shown in FIG. 12, the control circuit 101 performs correction so that a correction amount (X) stored in the first memory 102 is subtracted from a sensed temperature Tr (Temp) sensed by a digital temperature sensor that the temperature-sensing circuit 104 includes. Then, the control circuit 101 refers to a correction table stored in the second memory 103 based on a correction temperature (Temp_out) produced by the correction, and sets a voltage with respect to the corresponding temperature as a black display voltage. The black display voltage which has been set according to voltage control like this is supplied to the liquid crystal panel 10 through a D/A converter (DAC). This control enables a liquid crystal panel with a good display quality to be provided regardless of its use environment.

Fifth Embodiment

A liquid crystal display device 1 according to the fifth embodiment of the invention will be described below with reference to the drawings. The liquid crystal panel and the drive circuit are the same as those according to the second embodiment in their configurations.

1. Theory of the Fifth Embodiment

As described in the fourth embodiment, since the panel temperature of the liquid crystal panel 10 cannot be sensed directly, a temperature difference can arise between a temperature of the periphery of the liquid crystal panel 10 sensed by the temperature-sensing circuit 104 (sensed temperature Tr) and an actual panel temperature of the liquid crystal panel 10. Therefore, correction is performed so that the sensed temperature Tr sensed by the temperature-sensing circuit 104 is offset, and then the voltage is controlled according to the correction temperature thus obtained.

Figure 14:
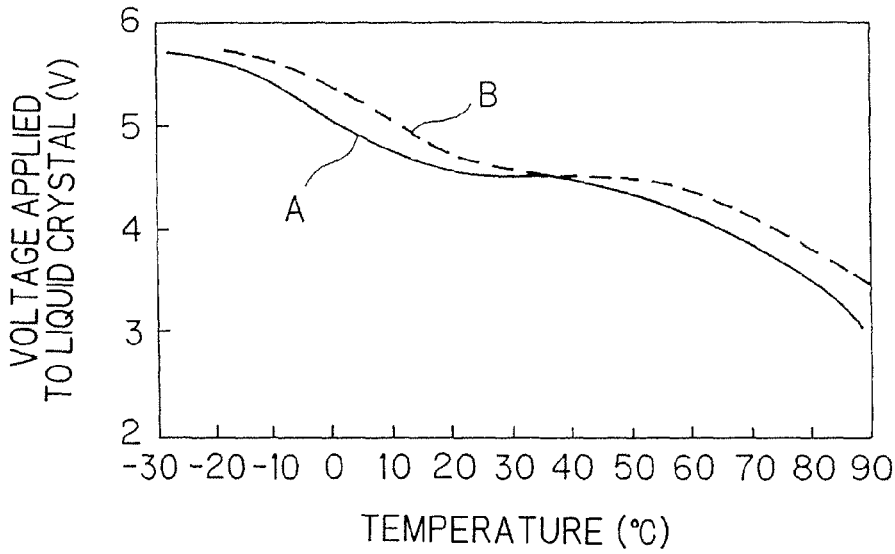
FIG. 14 is a view showing an example of a distribution of an optimal black display voltage with respect to a panel temperature and an example of a distribution obtained by shifting the optimal black display voltage distribution by 10° C. in association with the fifth and sixth embodiments.

In a stable condition after a predetermined length of time (e.g. thirty minutes) has elapsed from the power-on of the liquid crystal panel 10, the temperature difference ΔT between the sensed temperature Tr and the panel temperature T is substantially constant (e.g. 10° C.). Therefore, a correction temperature obtained by offsetting the sensed temperature Tr by a certain amount (e.g. subtracting 10° C. from the sensed temperature) is substantially identical with the panel temperature of the liquid crystal panel 10. On this account, it is possible to perform adequate voltage control depending on the correction temperature. This voltage control is equivalent to setting the black display voltage depending on a sensed temperature Tr based on the distribution B of the black display voltage which is obtained by upward shifting the distribution A of the optimal black display voltage with respect to the panel temperature by a certain amount of temperature (e.g. 10° C.), as shown in FIG. 14.

For example, in the case where the sensed temperature Tr is 20° C., the panel temperature is estimated to be 10° C. Therefore, 10° C. is taken for the correction temperature, and the black display voltage is set to 4.7 volts based on the distribution A. In addition, in the case where the sensed temperature Tr is 20° C., the black display voltage may be set to 4.7 volts based on the distribution B.

On the other hand, right after power-on of the liquid crystal panel 10, namely in a period of from the power-on to the time when a predetermined length of time has elapsed, the sensed temperature Tr is coincident with the panel temperature T in many cases. Therefore, when the sensed temperature Tr is offset by a certain amount as performed in the stable condition, the correction temperature thus obtained will be a value higher than the panel temperature of the liquid crystal panel 10.

For example, when the sensed temperature Tr is 20° C., the panel temperature is often 20° C. substantially, and it is most desirable to set the black display voltage to 4.5 volts based on the distribution A. However, even when an attempt is made to correct the sensed temperature Tr as in the case where the panel temperature is stable or to set the black display voltage based on the distribution B, the black display voltage will be set to 4.7 volts. Therefore, when voltage control is performed in this way, a voltage higher than a suitable black display voltage will be applied, thereby causing the reversal of gradation.

Hence, in this embodiment, based on a sensed temperature Tr sensed by the temperature-sensing circuit 104, the control circuit 101 sets the black display voltage to a predetermined constant voltage when a temperature below a particular temperature has been sensed, whereas the control circuit 101 sets the black display voltage to a voltage lower than the constant voltage when a temperature equal to or higher than the particular temperature has been sensed, in which the higher the sensed temperature is, the lower the voltage to which the black display voltage is set is.

2. Concrete Example of the Fifth Embodiment

Figure 15:
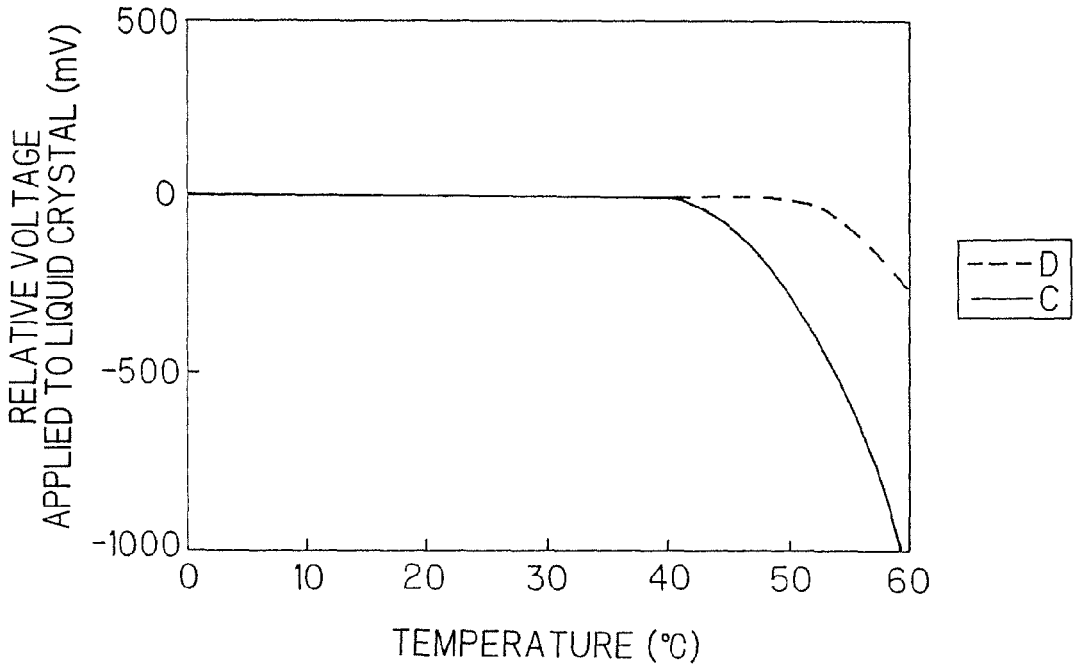
FIG. 15 is a view showing an example of a distribution of a black display voltage to be impressed on the liquid crystal layer with respect to a panel temperature applicable to the fifth embodiment.

In the fifth embodiment, a distribution as shown by C in FIG. 15 is adopted as an example of the distribution of the black display voltage to be applied to the liquid crystal layer 30 with respect to a panel temperature. The distribution C is a voltage distribution having a feature as follows, for example. That is, the voltage applied to a liquid crystal layer is constant with respect to a particular temperature, e.g. a temperature below 40° C., whereas with respect to a temperature equal to or above the particular temperature, the higher the temperature is, the further the voltage is lowered in comparison to the constant voltage. Incidentally, in FIG. 15, the predetermined constant voltage as a black display voltage to be applied to the liquid crystal layer 30 is the reference voltage (zero volt), and a black display voltage at a temperature other than the particular temperature is shown as a relative value.

When the distribution C is compared with the distribution A shown in FIG. 14, it is desirable that the distribution C is set so as to substantially coincide with the distribution A on a high temperature side not lower than the particular temperature. In addition, on a low temperature side below the particular temperature, the distribution C is set to a value lower than a black display voltage according to the distribution A.

When the panel temperature is stable, the black display voltage is set depending on the correction temperature obtained by offsetting the sensed temperature Tr by a certain amount, i.e. a temperature difference ΔT between the sensed temperature Tr and the panel temperature T when the panel temperature is stable, based on the distribution C shown in FIG. 15. Such voltage control represents to set the black display voltage depending on the sensed temperature Tr based on the distribution D of the black display voltage which results from upward shift of the distribution C by a certain amount of temperature difference, e.g. 10° C.

For example, in the case where the sensed temperature Tr is 60° C., the panel temperature T is estimated to be 50° C. Accordingly, a temperature of 50° C. is taken as the correction temperature, and the black display voltage is set to a voltage lower than the reference voltage by 250 millivolts based on the distribution C. Alternatively, in the case where the sensed temperature Tr is 60° C., the black display voltage may be set to a voltage lower than the reference voltage by 250 millivolts based on the distribution D.

Also, right after the power-on, a correction temperature obtained by offsetting the sensed temperature Tr by a certain amount is set as the black display voltage in the same way as in the stable condition.

For example, when the sensed temperature Tr is 20° C., the panel temperature T is substantially 20° C. in many cases. On this account, when offset is performed in the same way as in the case where the panel temperature is stable, the correction temperature becomes 10° C. The correction temperature necessary for setting the black display voltage differs from an actual panel temperature T as has been already described. However, as the distribution C follows a constant voltage curve on the low temperature side below the particular temperature, there is no difference in the value to which the black display voltage is set when the correction temperature is used to set the black display voltage based on the distribution C and when the sensed temperature is used to set the black display voltage based on the distribution D. In effect, the black display voltage set based on the distribution C when the correction temperature is 10° C., corresponds to the reference voltage, and the black display voltage set based on the distribution D when the sensed temperature is 20° C. also represents the reference voltage.

Thus, not only in the stable condition but also right after the power-on, a good display quality can be achieved regardless of its use environment, and particularly the panel temperature T.

3. Method of Voltage Control

Next, more detailed description of the method of voltage control will be presented.

In the above-described embodiment, the first memory 102 suffices as long as it stores at least a correction amount corresponding to the temperature difference ΔT between the sensed temperature Tr and the panel temperature T (e.g. data corresponding to "10") as data required for control of the black display voltage by the control circuit 101. In addition, the second memory 103 suffices as long as it stores at least a correction table covering the distribution of the black display voltage to be applied to the liquid crystal layer with respect to a panel temperature T, e.g. data covering the distribution C in FIG. 15, as data required for control of the black display voltage by the control circuit 101.

It is desirable that the second memory 103 include a rewritable storage medium. The correction table to be stored in the second memory 103 will probably differ depending on the use environment of the liquid crystal panel, and particularly there is high probability that the particular temperature will be changed. On this account, a rewritable storage medium is used in order to store a correction table, thereby making it possible to change the particular temperature and black display voltage appropriately depending on the use environment.

In the case of this configuration, as shown in FIG. 12, the control circuit 101 performs correction so that a correction amount (X) stored in the first memory 102 is subtracted from a sensed temperature Tr (Temp) sensed by the digital temperature sensor that the temperature-sensing circuit 104 includes. Then, the control circuit 101 refers to a correction table stored in the second memory 103 based on a correction temperature (Temp_out) produced by the correction, and sets a voltage with respect to the corresponding temperature as a black display voltage. The black display voltage which has been set according to voltage control like this is supplied to the liquid crystal panel 10 through the D/A converter (DAC).

A black display voltage control system including a combination of a digital temperature sensor and a control circuit like this enables handling of a sensed temperature as digital data, and therefore can determine the temperature-dependent distribution (control function) of the black display voltage freely. This control makes it possible to provide a liquid crystal panel having a good display quality regardless of its use environment.

4. Example of the First Modification

While in this embodiment, the particular temperature is set to 40° C., the invention is not so limited. The particular temperature may be set to an upper limit of a range of temperatures which are conceivable as a use environment after the power-on. It is desirable that the particular temperature be set within a range of 25 to 50° C. inclusive.

5. Example of the Second Modification

In regard to the configuration of the temperature-sensing circuit, in the case of a temperature-sensing circuit incorporating a thermistor, it is impossible to construct a system which sets a constant black display voltage on a low temperature side below a particular temperature in performing the voltage control according to the above-described embodiment because of the characteristics of the thermistor. Therefore, it is desirable to adopt a configuration including a digital temperature sensor as the configuration of the temperature-sensing circuit.

Sixth Embodiment

Figure 19:
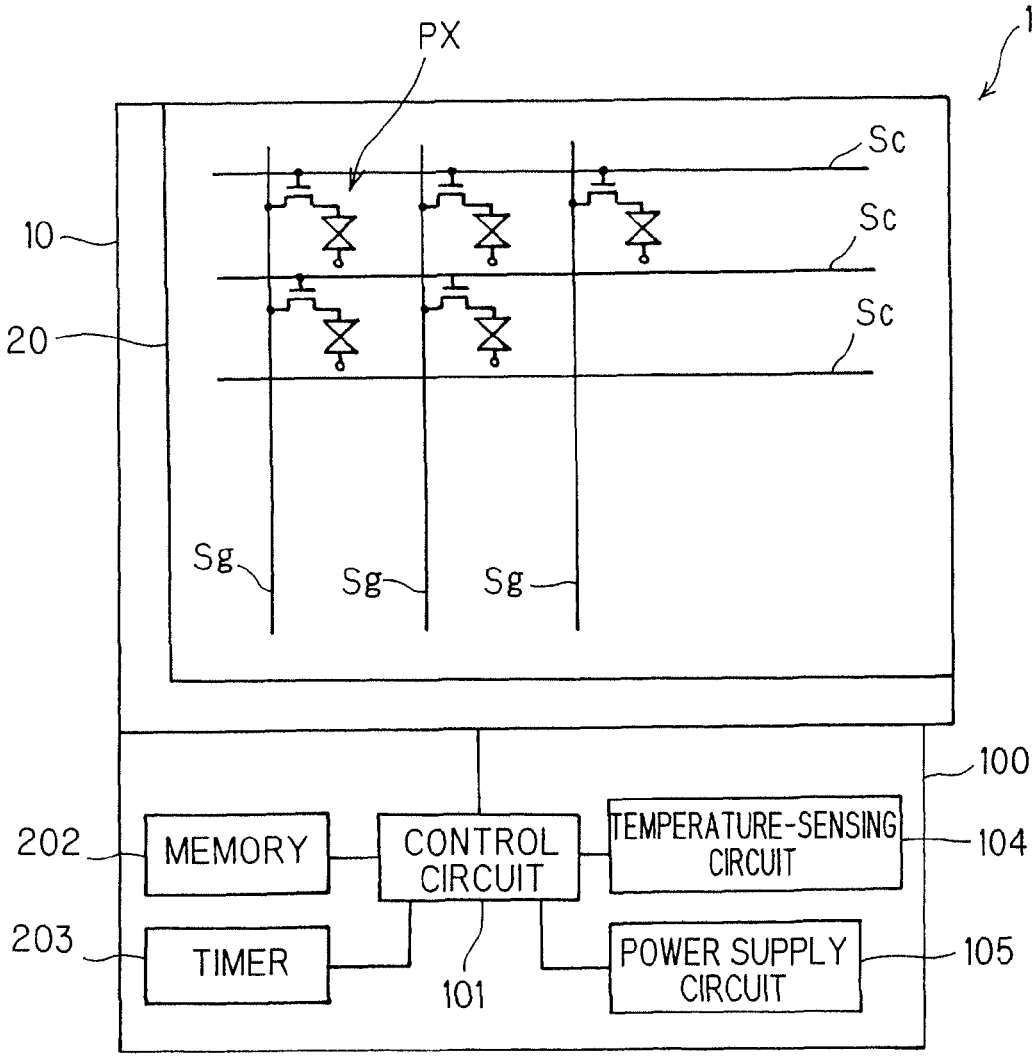
FIG. 19 is a view schematically showing a configuration of a liquid crystal panel in association with the sixth embodiment.

A liquid crystal display device 1 in association with the sixth embodiment of the embodiment will be described below with reference to the drawings. The liquid crystal panel is identical with that according to the second embodiment in its configuration. The sixth embodiment differs from the second one in the configuration of the drive circuit. Specifically, the drive circuit has only a memory 202 and a timer 203 which measures an elapsed time under the control of the control circuit 101, as shown in FIG. 19.

1. Concept of the Sixth Embodiment

As described in the fifth embodiment, in a stable condition after a predetermined length of time (e.g. thirty minutes) has elapsed from power-on of the liquid crystal panel 10, the temperature difference ΔT between the sensed temperature Tr and the panel temperature T is substantially constant (e.g. 10° C.). Therefore, a correction temperature obtained by offsetting the sensed temperature Tr by a certain amount (subtracting e.g. 10° C. from the sensed temperature) is substantially identical with the panel temperature of the liquid crystal panel 10. On this account, it is possible to perform adequate voltage control depending on the correction temperature. This voltage control is equivalent to setting the black display voltage depending on a sensed temperature Tr based on the distribution B of the black display voltage obtained by upward shifting the distribution A of the optimal black display voltage with respect to the panel temperature by a certain amount of temperature (e.g. 10° C.), as shown in FIG. 14.

When the black display voltage is set depending on a sensed temperature Tr based on the distribution B in the condition where the panel temperature is stable, or when the black display voltage is set according to a correction temperature based on the distribution A, the difference between a set value and the optimal black display voltage is ±0.1 volts in a range of the panel temperature of −10 to +70° C., for example, as shown in FIG. 16, and there is no problem in the display quality.

On the other hand, right after power-on of the liquid crystal panel 10, namely in a period of from the power-on to the time when a predetermined length of time has elapsed, the sensed temperature Tr is coincident with the panel temperature T in many cases. Therefore, when the sensed temperature Tr is offset by a certain amount as performed in the case where the panel temperature is stable, the correction temperature thus obtained will be a value higher than the panel temperature T of the liquid crystal panel 10. As a result, when voltage control is performed according to the correction temperature, a voltage higher than a suitable black display voltage Vs(T) will be applied, which will end up causing a display defect.

It has been often the case that when right after the power-on, the black display voltage is set depending on a sensed temperature Tr under the voltage control, the difference between a set value and the optimal black display voltage exceeds 0.1 volts in a range of the panel temperature of −10 to +70° C., for example, as shown in FIG. 17. In such case, the reversal of gradation has been occurred.

Hence, in this embodiment, the control circuit 101 sets the black display voltage according to a temperature sensed by the temperature-sensing circuit 104 to the time when the timer 203 measures a predetermined length of time from the power-on (i.e. right after the power-on) and corrects a temperature sensed by the temperature-sensing circuit 104 to set the black display voltage according to the corrected temperature after the timer 203 has measured the predetermined length of time from the power-on, i.e. during the time when the panel temperature is stable.

2. Concrete Example of the Sixth Embodiment

In the sixth embodiment, the voltage control (a method of setting a black display voltage) in the condition where the panel temperature is stable are the same as the voltage control described with reference to FIGS. 14 and 16. However, right after the power-on, correction of a sensed temperature Tr as conducted in the stable condition is not performed in consideration of the fact the sensed temperature Tr and the panel temperature T are coincident with each other in many cases. Specifically, the control circuit 101 activates the timer 203 concurrently with the power-on, and uses a sensed temperature Tr sensed by the temperature-sensing circuit 104 to set the black display voltage based on the distribution A shown in FIG. 14 before a predetermined length of time, e.g. thirty minutes, has elapsed. Thus, not only in the stable condition but also even right after the power-on, a good display quality can be achieved regardless of its use environment, and particularly the panel temperature.

According to this embodiment, when the black display voltage is set depending on a sensed temperature Tr based on the distribution A right after the power-on, the difference between a set value and the optimal black display voltage is ±0.1 volts in a range of the panel temperature of −10 to +70° C., for example, as shown in FIG. 18, and there is no problem in its display quality.

3. Example of Modification

The invention is not limited to the above-described embodiment, and various modifications and changes may be made without departing from what is regarded to be the subject matter of the invention.

3-1. Example of the First Modification

In the above-described embodiment, the memory 202 suffices as long as it stores at least correction data corresponding to the distribution of the optimal black display voltage with respect to a panel temperature (e.g. data corresponding to the distribution A shown in FIG. 14) as data required for control of the black display voltage by the control circuit 101.

In this configuration, the control circuit 101 activates the timer 203 concurrently with the power-on, and refers to correction data stored in the memory 202 based on a sensed temperature Tr sensed by the temperature-sensing circuit 104 to set a voltage with respect to the corresponding temperature as the black display voltage before a predetermined length of time has elapsed from the power-up. Also, the control circuit 101 refers to the timer 203, performs correction so that a predetermined value e.g. 10° C. is subtract from a sensed temperature Tr sensed by the temperature-sensing circuit 104 after the predetermined length of time has elapsed, refers to correction data stored in the memory 202 based on the correction temperature produced by the correction, and sets a voltage with respect to the corresponding temperature as a black display voltage. This voltage control enables a liquid crystal panel with a good display quality to be provided.

3-2. Example of the Second Modification

In the case of the above-described configuration, the control circuit 101 may be arranged in consideration of the fact that the difference between the panel temperature T and the sensed temperature Tr is substantially constant in a stable condition after the predetermined length of time has elapsed from the power-on so that it refers to correction data stored in the memory 202 based on a sensed temperature Tr sensed by the temperature-sensing circuit 104 in the stable condition to set a voltage below a voltage value with respect to a corresponding temperature as a black display voltage.

This voltage control makes possible to provide a liquid crystal panel having a relatively good display quality.

3-3. Example of the Third Modification

The memory 202 may store, as data required for control of the black display voltage by the control circuit 101, a first correction data corresponding to the distribution of the black display voltage to be applied to the liquid crystal layer with respect to a panel temperature (e.g. data corresponding to the distribution A shown in FIG. 14), and a second correction data corresponding to the distribution of the black display voltage to be applied to the liquid crystal layer with respect to a sensed temperature Tr (e.g. data corresponding to the distribution B shown in FIG. 14).

In the case of this configuration, the control circuit 101 activates the timer 203 concurrently with the power-on, refers to the first correction data stored in the memory 202 based on a sensed temperature Tr sensed by the temperature-sensing circuit 104 to set a voltage with respect to a corresponding temperature as a black display voltage before the predetermined length of time has elapsed from the power-up. Also, the control circuit 101 refers to the timer 203, and refers to the second correction data stored in the memory 202 to set a voltage with respect to the corresponding temperature as a black display voltage based on a sensed temperature Tr sensed by the temperature-sensing circuit 104 after the predetermined length of time has elapsed. Also, this voltage control makes possible to provide a liquid crystal panel having a good display quality.

3-4. Example of the Fourth Modification

In the above-described embodiment, the example where the method of setting a black display voltage differs between a period of the power-on to the time when thirty minutes have elapsed from the power-on and a period from and after the conclusion of the elapsed time has been described. However, the timing for changing the method of setting a black display voltage is not limited to the example. As it has been confirmed that the temperature reaches a stable condition in thirty to sixty minutes approximately, it is desirable to set the time when the method of setting a black display voltage is changed within this range.

3-5. Example of the Fifth Modification

In the above-described embodiment, the case where two methods of setting a black display voltage are applied to a period of from the power-on to the time when a predetermined length of time has elapsed and a period from and after the conclusion of the elapsed time respectively has been described. However, three or more methods of setting a black display voltage may be used by dividing a period after the power-on more finely. For example, a more stable display quality can be achieved when a method of setting a black display voltage including the following steps is applied: setting the black display voltage based on the first correction data in a period of from the power-on through the conclusion of an elapsed time of ten minutes, setting the black display voltage based on the second correction data in a period of from right after the end of the elapsed time of ten minutes through the conclusion of an elapsed time of twenty minutes, and setting the black display voltage based on the third correction data in a period of from right after the end of the elapsed time of twenty minutes through the conclusion of an elapsed time of thirty minutes, and so on.

3-6. Example of the Sixth Modification

In the case where at the time when the power is turned on with the past usage history of the liquid crystal display device 1 (e.g. time when the power was turn ON/OFF) left in the memory, the liquid crystal display device 1 has been used (i.e. the liquid crystal panel has stayed on) for thirty minutes or longer just before the power-on, the above-described method of setting a black display voltage is not applied right after the power-on, and the method of setting a black display voltage the same as the setting method used when the panel temperature is stable may be applied. In that way, a more stable display quality can be achieved.

What is claimed is:

1. A liquid crystal display device comprising:

an OCB mode liquid crystal panel including a pair of substrates and a liquid crystal layer held between the paired substrates;

a temperature-sensing unit configured to sense a temperature on or around a periphery of the liquid crystal panel when the liquid crystal panel is installed in a housing; and a control unit configured to set a black display voltage that is to be applied to the liquid crystal layer;

wherein the control unit produces a corrected sensed temperature by subtracting a predetermined correction amount from the sensed temperature sensed by the temperature-sensing unit, and controls the black display voltage based on the corrected sensed temperature, and the control unit produces the black display voltage which is kept constant, if and when the corrected sensed temperature is at or below a particular temperature.

2. The liquid crystal display device according to claim 1, wherein, by a control of the control unit, the black display voltage is decreased with an increase of the corrected temperature in accordance with a curve of an optimal black display voltage, if and when the corrected sensed temperature is above a particular temperature.

3. The liquid crystal display device according to claim 1, wherein, by a control of the control unit, the black display voltage is raised, if and when the corrected sensed temperature is on or below a predetermined temperature, so as not to exceed the optimal black display voltage.

4. The liquid crystal display device according to claim 1, wherein the particular temperature is around 35° C.

5. The liquid crystal display device according to claim 1 , wherein the predetermined correction amount is around 10° C.

6. The liquid crystal display device of claim 1, further comprising a first memory that stores the predetermined correction amount.

7. The liquid crystal display device of claim 6, wherein the first memory is configured to be rewritable.

8. The liquid crystal display device of claim 1, further comprising a second memory that stores a correction table of the black display voltage.

9. The liquid crystal display device of claim 1, wherein the temperature-sensing unit is a digital temperature sensor.

10. The liquid crystal display device of claim 1, wherein the control unit controls the black display voltage based on the sensed temperature sensed by the temperature-sensing unit when the sensed temperature is below a particular temperature.

11. The liquid crystal display device of claim 10, wherein the particular temperature is set to a temperature within a range of 25 to 50° C.

12. The liquid crystal display device of claim 1, wherein the control unit controls the black display voltage based on the sensed temperature sensed by the temperature-sensing unit until elapsing a predetermined length of time from power on.

13. A liquid crystal display device comprising:

an OCB mode liquid crystal panel including a pair of substrates and a liquid crystal layer held between the paired substrates;

a temperature-sensing unit configured to sense a temperature on or around a periphery of the liquid crystal panel when the liquid crystal panel is installed in a housing; and a control unit configured to set a black display voltage that is to be applied to the liquid crystal layer;

wherein the control unit produces a corrected sensed temperature by subtracting a constant correction amount from the sensed temperature sensed by the temperature-sensing unit; controls the black display voltage, which is a maximum voltage to be applied to the liquid crystal layer, based on the corrected sensed temperature if and when the sensed temperature being sensed by the temperature-sensing unit is stable; and controls the black display voltage based on the sensed temperature being sensed by the temperature-sensing unit until elapsing a predetermined length of time from power on, before being stable;

wherein the control unit further executes control so that:

the black display voltage is decreased with increase of the corrected temperature in accordance with a curve of an optimal black display voltage, if and when the corrected sensed temperature is above a first predetermined temperature;

the black display voltage is kept constant if and when the corrected sensed temperature is at or below the first predetermined temperature and at a same time above a second predetermined temperature; and the black display voltage is raised, if and when the corrected sensed temperature is at or below the second predetermined temperature, so as not to exceed the optimal black display voltage.

14. The liquid crystal display device according to claim 13, wherein the first predetermined temperature is around 35° C. or around 40° C.

15. The liquid crystal display device according to claim 13, wherein the constant correction amount is around 10° C. or around 20° C.

16. The liquid crystal display device according to claim 13, wherein the second predetermined temperature is around 20° C. or around 35° C.

17. The liquid crystal display device according to claim 13, wherein the temperature-sensing unit is mounted on a printed wiring board on which the control unit for the OCB mode liquid crystal panel is mounted.

* * * * *